US007671310B2

(12) United States Patent
Song et al.

(10) Patent No.: US 7,671,310 B2
(45) Date of Patent: Mar. 2, 2010

(54) MICROWAVE RANGE HAVING HOOD

(75) Inventors: Sung Bae Song, Gyeonggi-do (KR); Sang Bum Sohn, Seoul (KR); Jong Sik Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 5 days.

(21) Appl. No.: 11/967,466

(22) Filed: Dec. 31, 2007

(65) Prior Publication Data

US 2008/0156794 A1 Jul. 3, 2008

(30) Foreign Application Priority Data

Jan. 2, 2007 (KR) ..... 10-2007-0000137

(51) Int. Cl.
*H05B 6/64* (2006.01)
*F24C 15/32* (2006.01)

(52) U.S. Cl. ..... 219/757; 219/681; 219/400; 126/21 A; 126/21 R; 126/299 R; 126/299 D

(58) Field of Classification Search ..... 219/757, 219/681, 400; 126/21 A, 21 R, 299 R, 299 D
See application file for complete search history.

(56) References Cited

U.S. PATENT DOCUMENTS 6,686,576 B1 2/2004 Yang
7,049,568 B2 * 5/2006 Jeong ..... 219/757
7,122,771 B2 10/2006 Kang
7,180,041 B2 2/2007 Song et al.
2002/0084268 A1 * 7/2002 Kim ..... 219/757
2005/0121442 A1 6/2005 Shin
2005/0230385 A1 10/2005 Lee et al.
2006/0278216 A1 12/2006 Gagas et al.
2007/0119845 A1 5/2007 Song et al.

OTHER PUBLICATIONS

U.S. Appl. No. 11/968,293 to Song et al., filed Jan. 2, 2008.
U.S. Appl. No. 11/930,721 to Song et al., filed Oct. 31, 2007.
U.S. Appl. No. 11/930,676 to Song et al, filed Oct. 31, 2007.

* cited by examiner

*Primary Examiner*—Shawntina Fuqua
(74) *Attorney, Agent, or Firm*—McKenna Long & Aldridge LLP

(57) ABSTRACT

A microwave range having a hood for removing contaminated air includes a chamber having an inner cavity configured to receive items to be heated; an electric component room containing electric components, the electric component room being located above an upper wall of the chamber; and an outer case defining at least one passage between the chamber and the outer case through which contaminated air is received and discharged, and through which air for cooling the electric components flows.

8 Claims, 5 Drawing Sheets

MICROWAVE RANGE HAVING HOOD

CROSS REFERENCE TO RELATED APPLICATION

The present disclosure relates to subject matter contained in priority Korean Patent Application No. 2007-0000137, filed Jan. 2, 2007, which is herein expressly incorporated by reference in its entirety.

BACKGROUND

The present disclosure relates to a microwave range, and more particularly, to a microwave having a hood that exhausts contaminated air generated during a cooking operation of a cooking appliance installed in a lower portion.

A related art microwave range is a cooking appliance for heating food using microwaves or heat from a heater. An available microwave range includes a hood that filters contaminated matters from air including an exhaust gas generated during a cooking operation of a cooking appliance installed below the microwave range and exhausts the filtered air to an indoor space or an outdoor space.

However, a related art microwave range having a hood has the following limitations.

First, in a related art microwave range, a cooking room in which cooking is performed, and an electric component room containing electric components for oscillating microwaves, are asymmetrically provided in a chamber. Generally, the cooking room and the electric component room are adjacently provided side by side in the chamber. Therefore, the volume of the cooking room is relatively reduced by the space occupied by the electric component room.

Also, since the cooking room and the electric component room are asymmetrically provided in the chamber as described above, the front appearance of the microwave range is not horizontally symmetrical. Therefore, design for the front appearance of the microwave is limited, which reduces the appealing appearance of a product.

Also, a high voltage transformer of the electric components generates a magnetic field during its operation. The magnetic field of the high voltage transformer can be transferred to an outer case installed above and on both sides of the chamber which generates vibration or noises.

SUMMARY

Embodiments provide a microwave range having a hood function that is configured to prevent the volume of a cooking room from being relatively reduced due to the presence of an electric component room.

Embodiments also provide a microwave range having a hood function that improves a front appearance of a product by permitting a symmetrical appearance.

Embodiments also provide a microwave range having a hood function that is configured to minimize vibration and noises caused by electric components.

According to an aspect of the present invention, a microwave range having a hood for removing contaminated air includes a chamber having an inner cavity configured to receive items to be heated; an electric component room containing electric components, the electric component room being located above an upper wall of the chamber; and an outer case defining at least one passage between the chamber and the outer case through which contaminated air is received and discharged, and through which air for cooling the electric components flows.

The microwave range may further include a divider that divides the at least one passage into a plurality of passages including an air introduction passage for venting, through which contaminated air is introduced, an exhaust passage for venting, through which the contaminated air is exhausted, an air introduction passage for cooling, through which air for cooling the electric components is introduced, and an exhaust passage for cooling, through which the air for cooling the electric components is exhausted.

The divider may include a top bracket extending from an edge of the upper wall of the chamber to an inner surface of a side of the outer case; and first and second air walls provided on the upper wall of the chamber and the top bracket, wherein the top bracket separates the air introduction passage for venting from the air introduction passage for cooling, wherein the first air wall separates the air introduction passage for venting from the air introduction passage for cooling, and separates the exhaust passage for venting from the air introduction passage for cooling, wherein the second air wall separates the air introduction passage for venting from the exhaust passage for cooling, and separates the exhaust passage for venting from the exhaust passage for cooling.

Receiving and discharging of the contaminated air may be performed by a vent fan assembly provided on the upper wall of the chamber. The vent fan assembly may be located at a rear end of the upper wall of the chamber that is adjacent to the electric component room to introduce and exhaust contaminated air flowing through the at least one passage between the chamber and the outer case.

Cooling of the electric components may be performed by a cooling fan assembly located in a portion of the electric component room in front of the electric components. Cooling of the electric components may be performed by a cooling fan assembly located in a portion of the electric component room behind the electric components.

The microwave range may further include a cover bracket positioned above the electric component room and defining an upper wall thereof.

According to an aspect of the present invention, a microwave range having a hood for removing contaminated air includes an electric component room located on an upper wall of a chamber and containing a variety of electric components; a vent fan assembly that intakes and exhausts contaminated air; a cooling fan assembly that provides a flow of air for cooling the electric components; a passage through which air flows by driving of the cooling fan assembly and the vent fan assembly; and a divider that separates the electric component room from the passage.

The divider may include a top bracket extending from the upper wall of the chamber to a side of an outer case to form a bottom of the electric component room, the outer case covering an upper portion and both sides of the chamber; an air wall located on the top bracket and forming a side surface of the electric component room; and a cover bracket located on an upper end of the air wall and forming a ceiling of the electric component room.

The cooling fan assembly may be installed in a fan bracket provided on at least one of the air wall and an air guide. The fan bracket may be located in a portion of the electric component room in front of the electric components. The fan bracket may be located in a portion of the electric component room behind the electric components.

According to an aspect of the present invention, a microwave range having a hood for removing contaminated air includes an air introduction passage for venting, through which contaminated air is introduced by driving of a vent fan assembly; an exhaust passage for venting, through which contaminated air is exhausted to outside by driving of the vent fan assembly; an air introduction passage for cooling, through which air is introduced for cooling electric components installed in an electric component room by driving of a cooling fan assembly, the electric component room being located on an upper wall of a chamber; and an exhaust passage for cooling, through which air introduced for cooling the electric components is exhausted to outside by driving of the cooling fan assembly.

The air introduction passage for venting may include a first air introduction passage for venting located between the chamber and a base plate located below the chamber; and a second air introduction passage for venting located between the chamber and both sides of an outer case positioned over the upper wall and both sides of the chamber, wherein contaminated air introduced via an air inlet for venting formed in the base plate flows horizontally and vertically toward an air inlet of the vent fan assembly along the first and second air introduction passages for venting.

The exhaust passage for venting may be located above the chamber, contaminated air exhausted from a discharge portion of the vent fan assembly being exhausted via one of an indoor air outlet for venting located in front of the chamber, and an outdoor air outlet for venting located in an upper wall of an outer case positioned over the upper wall and on both sides of the chamber.

The electric components may be located in the exhaust passage for cooling. The electric components may be located in the air introduction passage for cooling.

The exhaust passage for cooling may include a first exhaust passage for cooling, through which air exhausted from a discharge portion of the cooling fan assembly flows to a cooking room located inside the chamber; and a second exhaust passage for cooling, through which air that has circulated through the cooking room is exhausted to outside. The first exhaust passage for cooling may pass through an exhaust duct for cooling that allows the electric component room to communicate with the cooking room.

According to the present disclosure, the volume of a cooking room is maximized, a front appearance is improved, and vibration and noises generated during an operation of a product are minimized.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
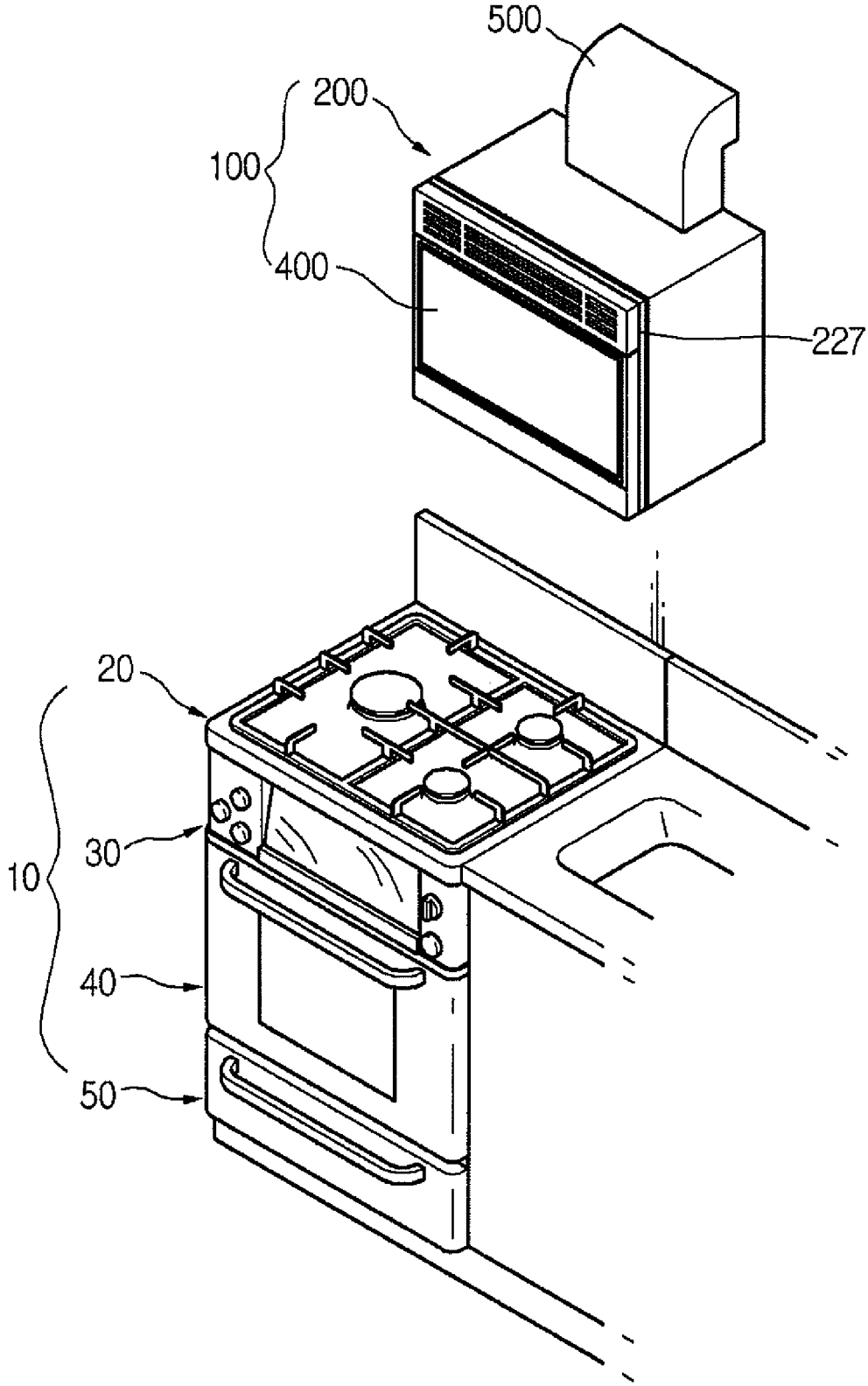
FIG. 1 is a perspective view of a microwave range having a hood located above a cooking appliance according to an embodiment of the present invention.
Figure 2:
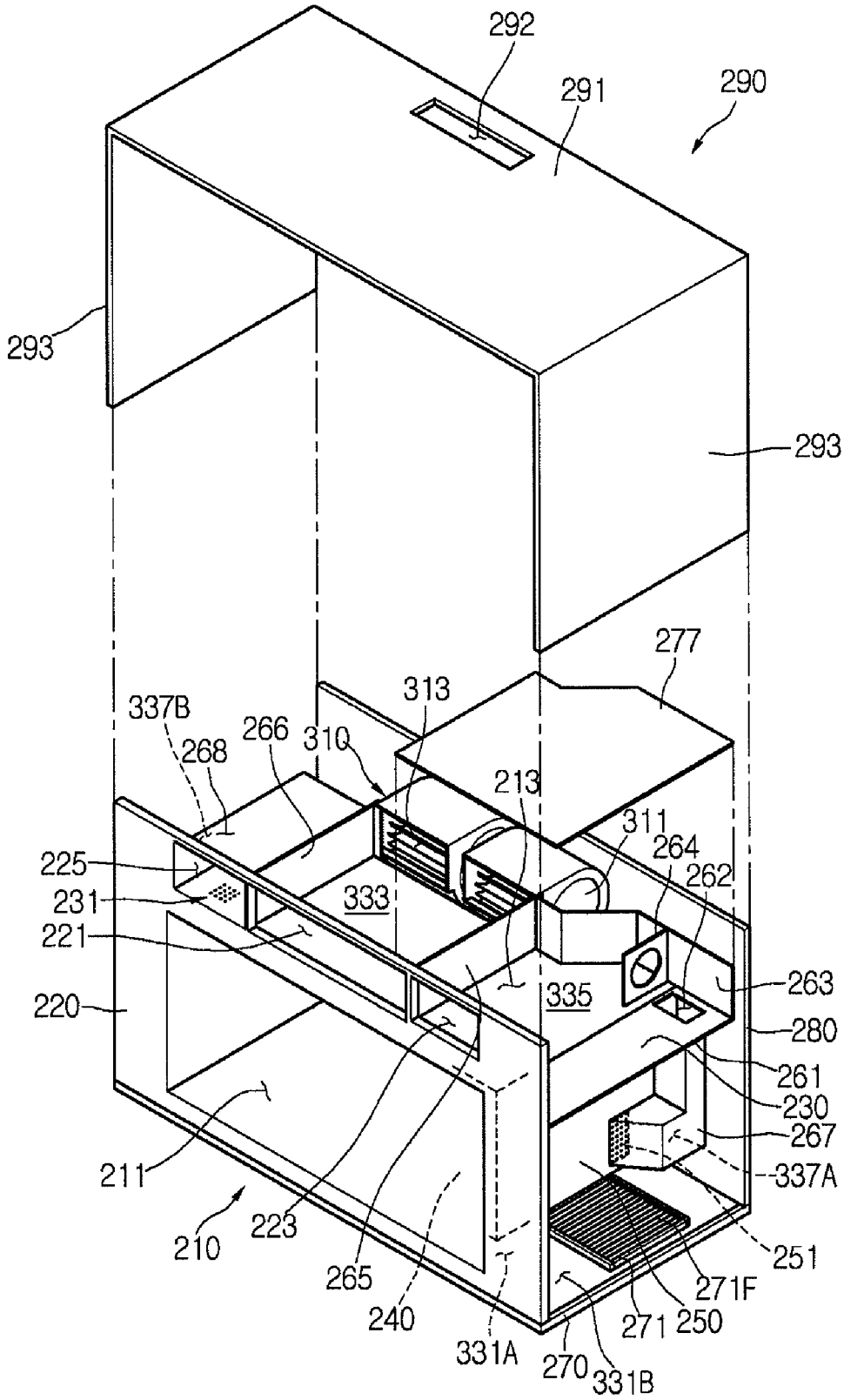
FIG. 2 is an exploded perspective view of a microwave range having a hood with electric components removed from an electric component room according to a first embodiment.
Figure 3:
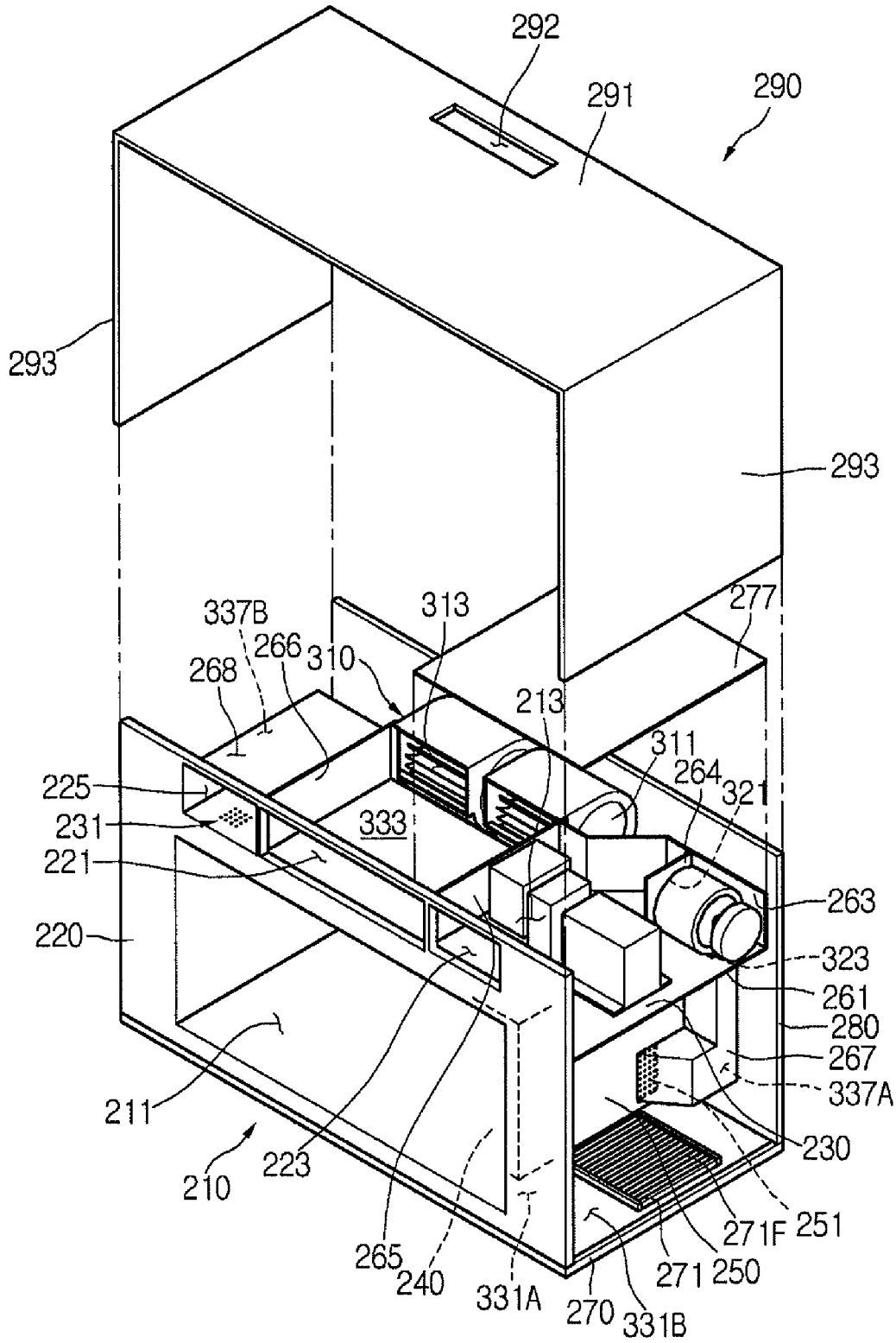
FIG. 3 is an exploded perspective view of a microwave range having a hood with electric components installed in an electric component room according to the first embodiment.

FIG. 1 is a perspective view of a microwave range having a hood installed above a cooking appliance according to an embodiment of the present invention, FIG. 2 is an exploded perspective view of a microwave range having a hood with electric components removed from an electric component room according to a first embodiment, FIG. 3 is an exploded perspective view of a microwave range having a hood with electric components installed in an electric component room according to the first embodiment.

Referring to FIGS. 1 to 3, a gas oven range 10 is installed in a kitchen. The gas oven range 10 includes a top burner unit 20, a grill unit 30, an oven unit 40, and a drawer unit 50. The top burner unit 20 performs a food cooking operation using combustion of a gas. Also, the grill unit 30, the oven unit 40, and the drawing unit 50 perform a food cooking operation using a heater. Although a gas oven range is shown in FIG. 1, the microwave range according to the present invention can be located above any suitable type of cooking appliance.

A microwave range 100 having a hood (referred to as a microwave range 100 hereinafter) is installed above the gas oven range 10. The microwave range 100 performs a cooking function of cooking food using microwaves, and a hood function of filtering contaminated matters from air including an exhaust gas generated during a cooking operation of the gas oven range 10 and exhausting the filtered air to the outside. The microwave range 100 includes a main unit 200 and a door 400. Also, the main unit 200 is provided at its upper surface with an outdoor duct 500 for exhausting contaminated air to the outside.

Referring to FIG. 2, a front plate 220 forms the front side of a chamber 210 constituting the main unit 200. Also, a top plate 230, a bottom plate 240, a pair of side plates 250, and a rear plate form the upper and lower sides, both side surfaces, and rear surface of the chamber 210, respectively.

The front plate 220 is provided at its upper end with an indoor air outlet 221 for a hood, an air inlet 223 for cooling, and an air outlet 225 for cooling. Referring to FIG. 2, the air inlet 223 for cooling and the air outlet 225 for cooling are provided in the right and left sides around the indoor air outlet 221 for the hood, respectively. The indoor air outlet 221 for the hood is designed for exhausting contaminated air to an indoor space. The air inlet 223 for cooling and the air outlet 225 for cooling are designed for introducing and exhausting air for cooling electric components which will be described below, respectively.

A vent grill 227 (refer to FIG. 1) is provided to the front upper end of the front plate 220 that corresponds to the indoor air outlet 221 for the hood, the air inlet 223 for cooling, and the air outlet 225 for cooling. The vent grill 227 shields the indoor air outlet 221 for the hood, the air inlet 223 for cooling, and the air outlet 225 for cooling, and allows air to be exhausted in a predetermined direction.

The side plates 250 and the top plate 230 are respectively provided with a plurality of air introducing through holes 251 and exhaust through holes 231. The air introducing through holes 251 and the exhaust through holes 231 are designed for communication with a cooking room 211, an electric component room 213, and an exhaust passage 337A, 337B for cooling.

The cooking room 211 is provided inside the chamber 210. The cooking room 211 is where food is cooked. The cooking room 211 is selectively opened/closed using the door 400.

A top bracket 261 extends laterally from the upper end of one of the side plates 250, that is, the side plate on the right in the present embodiment. The front end and right end of the top bracket 261 are closely attached on the rear side of the front plate 220 and the inner surface of one of the sides 293 of an outer case 290. The rear end of the top bracket 261 is separated a predetermined distance from the inner side of a back plate 280. The top bracket 261 serves as a partition between air introduction passages 331A and 331B for a hood, and an air introduction passage 335 for cooling.

The top bracket 261 is provided at one side with a communication opening 262. The communication opening 262 is configured to allow the electric component room 213 to communicate with exhaust passages 337A and 337B for cooling. In the present embodiment, the communication opening 262 is provided at the rear end of the top bracket, but is not limited thereto.

The top plate 230 and the top bracket 261 are provided on their upper sides with an air wall 263. The air wall 263 extends horizontally along the upper sides of the top plate 230 and the top bracket 261. A portion of the air wall 263 on the upper surface of the top bracket 261 extends along the rear edge on the upper side of the top bracket 261. Also, in FIG. 2, the right end of the air wall 263 is closely attached to the inner surface of one of the sides 293 of the outer case 290.

The air wall 263 is provided on one side with a fan bracket 264. The fan bracket 264 is designed for installing a cooling fan assembly 320 therein. The fan bracket 264 is provided on one side of the air wall 263 that is adjacent to the communication opening 262.

The top plate 230 is provided on its upper side with a pair of air guides 265 and 266. The air guides 265 and 266 extend in a back and forth direction on the top plate 230 and/or the top bracket 261. The air guides 265 and 266 substantially divide a passage surrounded by the top plate 230, the top bracket 261, and the upper side of the outer case 290 into the air introducing passages 331A and 331B for the hood, an exhaust passage 333 for the hood, the air introducing passage for cooling 335, and the exhaust passage 337A and 337B for cooling. In FIG. 2, the air guide 265 on the right is referred to as a first air guide 265, and the air guide 266 on the left is referred to as a second air guide 266.

The first and second air guides 265 and 266 extend in a back and forth direction on upper sides of the top plate 230 that corresponds to a space between the indoor air outlet 221 for the hood and the air inlet 223 for cooling, and a space between the indoor air outlet 221 for the hood and the air outlet 225 for cooling. The front ends of the first and second air guides 265 and 266 are closely attached on the rear side of the front plate 220. Also, the rear ends of the first and second air guides 265 and 266 are separated a predetermined distance from the inner side of the back plate 280. This provide space for accommodating a vent fan assembly 310. The rear end of the first air guide 265 is connected to one end of the air wall 263. The air wall 263 and the first air guide 265 can be integrally formed. Meanwhile, the first air guide 265 is substantially provided on the upper side of the top plate 230 according to an embodiment. However, the first air guide 265 can be provided on the upper side of the top bracket 261 depending on the size of the electric component room 213.

The top plate 230 and the top bracket 261 are provided on their upper side with a cover bracket 277. The cover bracket 277 is formed in a plate shape corresponding to the shape of the top bracket 261 and a portion of the top plate 230. In FIG. 2, the front end of the cover bracket 277 is closely attached on the rear side of the front plate 220, and the right end of the cover bracket 277 is closely attached on the inner surface of one of the sides 293 of the outer case 290. The lower edge of the cover bracket 277 is closely attached on the air wall 263 and the first air guide 265. The top bracket 261 can be formed of any suitable material, such as a synthetic resin to prevent magnetic force generated during an operation of a high voltage transformer from being transferred to the outer case 290, which will be described below in detail.

The side plate 250 on the right is provided with a first exhaust duct 267 for cooling. The first exhaust duct 267 for cooling serves as a partition between the air introduction passages 331A and 331B for the hood, and the exhaust passages 337A and 337B for cooling, and guides air into the cooking room 211 via the communication opening 262 and the air introducing through holes 251. For this purpose, both ends of the first exhaust duct 267 communicate with the air introducing through holes 251 and the communication opening 262, respectively. The first exhaust duct 267 for cooling is required because the air introducing through holes 251 are formed in the side plates 250. If the air introducing through holes 251 are formed in the top plate 230 corresponding to an area inside of the electric component room 213, the first exhaust duct 267 can be omitted.

A second exhaust duct 268 for cooling is provided on the upper side of the top plate 230 on the opposite side of the first and second air guides 265 and 266. The second exhaust duct 268 for cooling serves as a partition between the air introducing passages 331A and 331B for venting, and the exhaust passages 337A and 337B for cooling, and guides air exhausted via the exhaust through holes 231 to the air outlet 225 for cooling. For this purpose, the second exhaust duct 268 for cooling is provided on the upper side of the top plate 230 such that the exhaust through holes 231 are located inside the second exhaust duct 268.

The electric component room 213 is provided on the upper side of the chamber 210. The electric component room 213 is substantially located on a portion of the air introducing passage 335 for cooling that is surrounded by the top plate 230, the top bracket 261, the cover bracket 277, one of the sides of the outer case 290, the air wall 263, and the first air guide 265. In other words, the bottom and the ceiling of the electric component room 213 are formed by the top plate 230, the top bracket 261, and the cover bracket 277. The sides of the electric component room 213 are formed by one of the sides 293 of the outer case 290, the air wall 263, the front plate 220 and the first air guide 265. A variety of electric components for oscillating microwaves such as a magnetron, a high voltage capacitor, and a high voltage transformer are installed in the electric component room 213. Particularly, the high voltage transformer of the electric components generates magnetic force during its operation. Since the top bracket 261 is formed of a synthetic resin, the magnetic force generated from the high voltage transformer is prevented from being delivered to the outer case 290.

Meanwhile, a base plate 270 is installed at a lower portion of the chamber 210. The base plate 270 substantially forms a lower appearance of the main unit 200. The base plate 270 is installed below the chamber 210 such that the lower surface of the bottom plate 240 and the upper surface of the base plate 270 are vertically separated a predetermined distance from each other. Therefore, a predetermined space is formed between the bottom plate 240 and the base plate 270. The first air introducing passage 331A is provided in the space.

The base plate 270 is provided with an air inlet 271 for a hood. The air inlet 271 for the hood is formed by cutting a portion of the base plate 270 in a predetermined shape. The air inlet may be of any suitable shape, such as a horizontally extending rectangular shape. The air inlet 271 for the hood serves as an entry through which contaminated air is introduced. The air inlet 271 for the hood is provided with a filter 271F, which removes foreign substances contained in contaminated air introduced via the air inlet 271 for the hood to purify the contaminated air.

The chamber 210 is provided at its rear end with the back plate 280. The back plate 280 forms the rear appearance of the main unit 200. The back plate 280 is closely attached on the front side of a rear plate. That is, a space where a passage can be provided is not formed between the rear plate and the back plate 280. An outer case 290 is installed at a upper portion and both sides of the chamber 210. The outer case 290 substantially includes a top 291 forming the upper appearance of the main unit 200, and two lateral sides 293 forming lateral appearances of the main unit 200. The top 291 and both lateral sides 293 of the outer case 290 are separated vertically and horizontally by a predetermined distance from the top plate 230 and the side plates 250, respectively. Also, an outdoor air outlet 292 for a hood is formed at the rear end on the top 291 of the outer case 290. The outdoor air outlet 292 for the hood is designed for exhausting contaminated air to the outside through the outdoor duct 500.

A vent fan assembly 310 is installed at the rear end on the upper side of the top plate 230. The vent fan assembly 310 is designed for providing driving force for introducing and exhausting contaminated air. With the vent fan assembly 310 installed at the rear end on the upper side of the top plate 230, an air inlet 311 and a discharge portion 313 of the vent fan assembly 310 respectively face both sides and the front of the chamber 210. However, the vent fan assembly 310 can be installed at the rear end on the upper side of the top plate 230 such that the air inlet 311 and the discharge portion 313 respectively face both sides and the upper side of the chamber 210.

Meanwhile, referring to FIG. 3, the cooling fan assembly 320 is installed inside the electric component room 213. The cooling fan assembly 320 provides driving force for flowing of air for cooling the electric components. In an embodiment, the cooling fan assembly 320 is installed on the fan bracket 264 so that it is located to the rear of the electric components. At this point, the air inlet 321 of the cooling fan assembly 320 is located to the rear of the electric components with respect to the air inlet 223 for cooling. The discharge portion 323 of the cooling fan assembly 320 is located right above the communication opening 262 to face the communication opening 262. Therefore, the electric components are cooled by air introduced via the air inlet 223 for cooling and introduced to the air inlet 321 of the cooling fan assembly 320.

Meanwhile, the chamber 210 is provided with a plurality of passages, i.e., the air introducing passages 331A and 331B for the hood, the exhaust passage 333 for the hood, the air introducing passage 335 for cooling, and the exhaust passages 337A and 337B for cooling. The air introducing passages 331A and 331B for the hood, and the exhaust passage 333 for the hood are portions through which contaminated air flows. The air introducing passage 335 for cooling, and the exhaust passages 337A and 337B for cooling are portions through which air for cooling the electric components flows.

The air introducing passages 331A and 331B for the hood include a first air introducing passage 331A for a hood and a second air introducing passage 331B for a hood. The first air introducing passage 331A for the hood is provided below the chamber 210, that is, between the bottom plate 240 and the base plate 270. Contaminated air introduced via the air inlet 271 for the hood flows through the first air introducing passage 331A for the hood. The second air introducing passage 331B is provided at both sides of the chamber 210, that is, between the side plates 250 and both sides 293 of the outer case 290. The second air introducing passage 331B for the hood has a lower end communicating with one end of the first air introducing passage 331A for the hood. Also, the second air introducing passage 331B for the hood has an upper end communicating with the air inlet 311 of the vent fan assembly 310. Contaminated air flowing through the first air introducing passage 331A for the hood flows toward the air inlet 311 of the vent fan assembly 310 via the second air introducing passage 331B for the hood.

The exhaust passage 333 for the hood is provided at an upper portion of the chamber 210 that is located between the first and second air guides 265 and 266, that is, between the top plate 230 and the top of the outer case 290. Contaminated air exhausted via the discharge portion 313 of the vent fan assembly 310 flows through the exhaust passage 333 for the hood.

The air introducing passage 335 for cooling is surrounded by the first air guide 265, the cover bracket 277, a portion of the top plate 230, one of the sides 293 of the outer case 290, the front plate 220 and the top bracket 261. Air introduced via the air inlet 223 for cooling flows through the air introducing passage 335 for cooling.

The exhaust passages 337A and 337B for cooling include a first exhaust passage 337A for cooling and a second exhaust passage 337B for cooling. Air that has cooled the electric components and is delivered to the cooking room 211 flows through the first exhaust passage 337A for cooling. The exhaust passage 337A for cooling is substantially provided inside the first exhaust duct 267 for cooling. The second exhaust passage 337B for cooling is a portion through which air that circulates through the inside of the cooking room 211 and is exhausted to the outside via the air outlet 225 for cooling flows. The second exhaust passage 337B for cooling is substantially provided inside the second exhaust duct 268 for cooling.

An operation of a microwave range having a hood will be described below according to an embodiment of the present disclosure.

First, a process of circulating contaminated air will be described below according to the microwave range having the hood in an embodiment of the present disclosure.

When a user operates the microwave range, the vent fan assembly 310 is driven. When the vent fan assembly 310 is driven, contaminated air including an exhaust gas generated during a cooking operation of a gas oven range 10 is introduced via the air inlet 271 for the hood. The contaminated air introduced via the air inlet 271 flows through the first air introducing passage 331A for the hood. While the contaminated air is introduced via the air inlet 271 for the hood, various foreign substances contained in the contaminated air are filtered by the filter 271F.

Meanwhile, air flowing through the first air introducing passage 331A for the hood flows through the second air introducing passage 331B for the hood by continuous driving of the vent fan assembly 310 and is introduced to the air inlet 311 of the vent fan assembly 310. Air introduced to the air inlet 311 of the vent fan assembly 310 is exhausted by the discharge portion 313 of the vent fan assembly 310.

The air exhausted by the discharge portion 313 of the vent fan assembly 310 flows through the exhaust passage 333 for the hood and is exhausted to an indoor space via the indoor air outlet 221 for the hood and the vent grill 227. Of course, in the condition that the vent fan assembly 310 is installed such that the discharge portion 311 faces upward, that is, faces the outdoor air outlet 292 for the hood, air exhausted by the discharge portion 313 of the vent fan assembly 310 may be exhausted to the outside via the outdoor air outlet 292 and the outdoor duct 500 (refer to FIGS. 1 and 2).

Next, a process of circulating air for cooling the electric components will be described according to an embodiment of the present disclosure.

As described above, when a microwave range operates, the cooling fan assembly 320 is driven. Air introduced via the air inlet 223 for cooling by the driving of the cooling fan assembly 320 flows through the air introducing passage 335 for cooling.

The air flowing through the air introducing passage 335 for cooling is introduced to the air inlet 321 of the cooling fan assembly 320 by continuous driving of the cooling fan assembly 320. While the air introduced via the air inlet 223 for cooling flows through the air introducing passage 335 for cooling, the electric components are cooled.

The air introduced to the air inlet 321 of the cooling fan assembly 320 is exhausted by the discharge portion 323 of the cooling fan assembly 320. The air exhausted by the discharge portion 323 of the cooling fan assembly 320 is delivered to the first exhaust passage 337A for cooling via the communication opening 262. The air delivered to the first exhaust passage 337A for cooling flows through the first exhaust passage 337A, and is delivered into the cooking room 211 via the air introducing through holes 251.

The air delivered into the cooking room 211 circulates through the cooking room 211. A variety of foreign substances generated in the inside of the cooking room 211 during a cooking process is included in air while the air circulates through the cooking room 211.

The air that has circulated through the cooking room 211 is delivered to the second exhaust passage 337B for cooling via the air exhaust holes 231. The air that has been delivered to the second exhaust passage 337B for cooling is exhausted to an indoor space via the air outlet 225 for cooling and the vent grill 227.

Hereinafter, a microwave range having a hood will be described below according to another embodiment with reference to the accompanying drawings.

Figure 4:
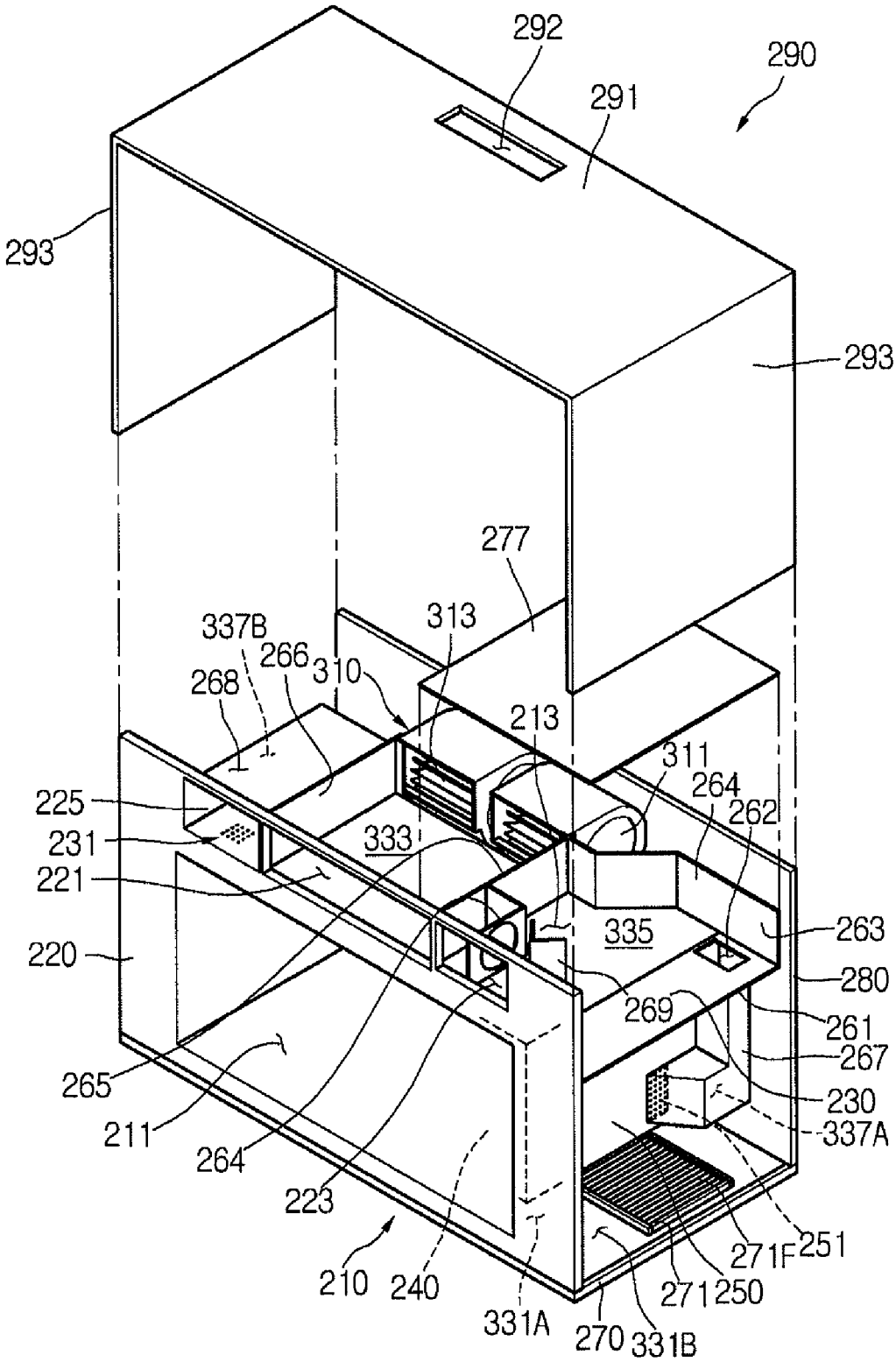
FIG. 4 is an exploded perspective view of a microwave range having a hood with electric components removed from an electric component room according to a second embodiment.
Figure 5:
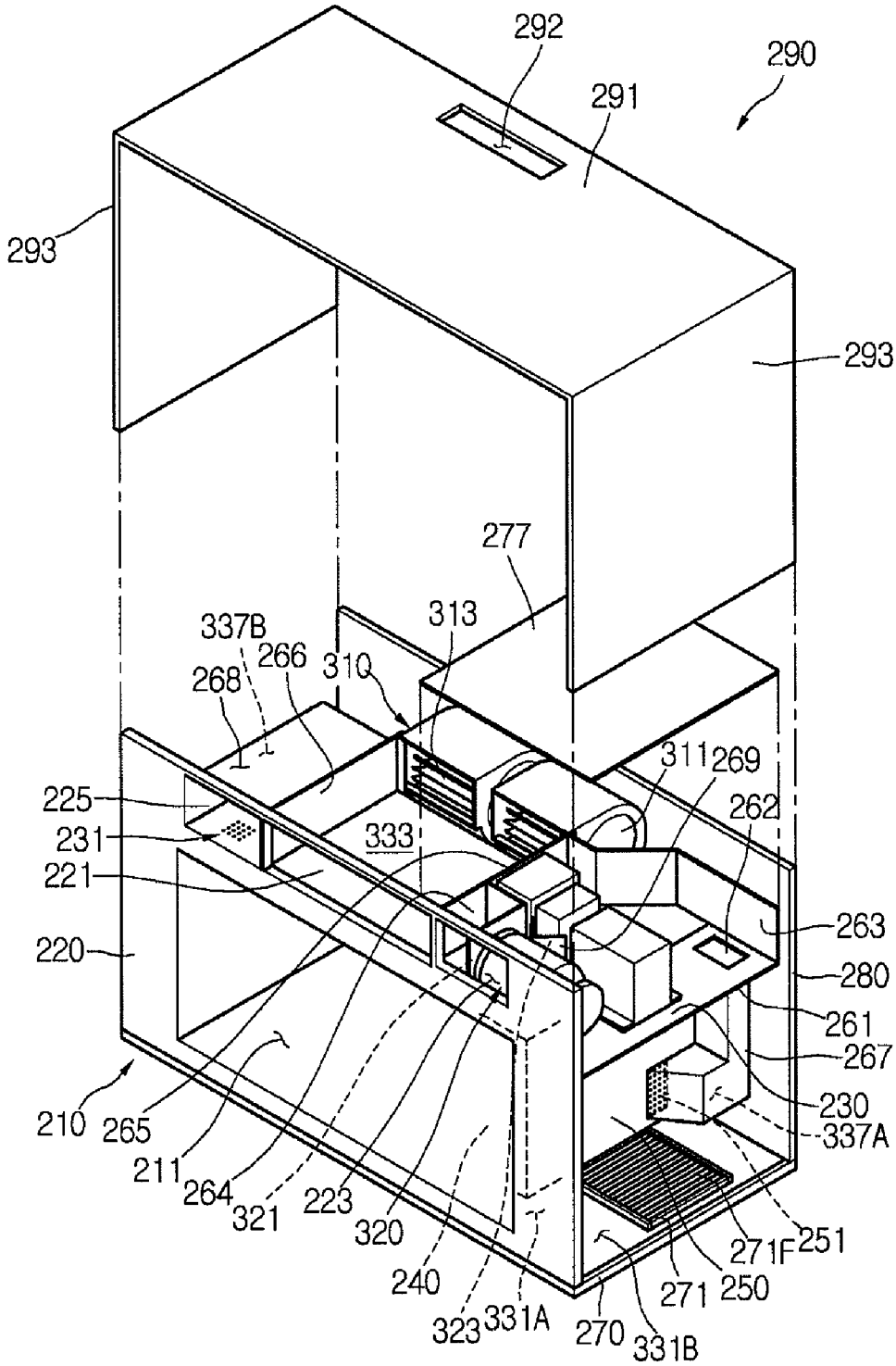
FIG. 5 is an exploded perspective view of a microwave range having a hood with electric components installed in an electric component room according to the second embodiment.

FIG. 4 is an exploded perspective view of a microwave having a hood with electric components removed from an electric component room according to a second embodiment, and FIG. 5 is an exploded perspective view of a microwave having a hood with electric components installed in an electric component room according to the second embodiment. In description of the another embodiment, same reference numerals of FIGS. 1 to 3 will be used for the same elements as those of the previous embodiment.

Referring to FIGS. 4 and 5, a cooling fan assembly 320 is installed at the front end of an electric component room 213 forward or in front of the electric components. For this purpose, the fan bracket 264 in which the cooling fan assembly 320 is installed is provided on one side of a first air guide 265 adjacent to an air inlet 223 for cooling. Therefore, the electric components are cooled by air introduced via the an air inlet 321 of the cooling fan assembly 320 and discharged via a discharge portion 323 of the cooling fan assembly 320 according to the second embodiment.

Meanwhile, an air guide member 269 is provided in a portion of the electric component room 213 that corresponds to the front of a discharge portion 323 of the cooling fan assembly 320. The air guide member 269 is designed for distributing and guiding air discharged by the discharge portion 323 of the cooling fan assembly 320 to allow the air to uniformly flow through the electric component room 213. In the embodiment, the air guide member 269 allows air discharged from the discharge portion 323 of the cooling fan assembly 320 to flow toward both sides of the electric component room 213. For this purpose, the air guide member 269 has a V shaped cross-section inclined to a predetermined angle in a direction distant away from an extension axis of the center of the discharge portion 323 of the cooling fan assembly 320.

Since the rest of the construction in the second embodiment is the same as that of the first embodiment, detailed description thereof will be omitted.

The following effects are expected according to the above-described microwave range having a hood.

A microwave range having a hood function is configured to prevent the volume of a cooking room from being relatively reduced due to the presence of an electric component room. Further, a microwave range having a hood function improves a front appearance of a product by permitting a symmetrical appearance. Further, a microwave range having a hood function is configured to minimize vibration and noises caused by electric components.

According, the volume of a cooking room is maximized, a front appearance is improved, and vibration and noises generated during an operation of a product are minimized.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A microwave range having a hood for removing contaminated air, the microwave range comprising:

a chamber having an inner cavity configured to receive items to be heated;

an electric component room containing electric components, the electric component room being located above an upper wall of the chamber;

an outer case defining at least one passage between the chamber and the outer case through which contaminated air is received and discharged, and through which air for cooling the electric components flows, wherein receiving and discharging of the contaminated air is performed by a vent fan assembly provided on the upper wall of the chamber, and the vent fan assembly is located at a rear end of the upper wall of the chamber that is adjacent to the electric component room to introduce and exhaust contaminated air flowing through a couple of passages provided between both sides of the chamber and both sides of the outer case positioned over the upper wall and both sides of the chamber;

a divider that divides the at least one passage into a plurality of passages including an air introduction passage for venting, through which contaminated air is introduced, the divider comprising:

a top bracket extending from an edge of the upper wall of the chamber to an inner surface of a side of the outer case; and first and second air walls provided on the upper wall of the chamber and the top bracket, wherein the top bracket separates the air introduction passage for venting from the air introduction passage for cooling, wherein the first air wall separates the air introduction passage for venting from the air introduction passage for cooling, and separates the exhaust passage for venting from the air introduction passage for cooling, and wherein the second air wall separates the air introduction passage for venting from the exhaust passage for cooling, and separates the exhaust passage for venting from the exhaust passage for cooling;

an exhaust passage for venting, through which the contaminated air is exhausted;

an air introduction passage for cooling, through which air for cooling the electric components is introduced; and an exhaust passage for cooling, through which the air for cooling the electric components is exhausted.

2. The microwave range according to claim 1, wherein cooling of the electric components is performed by a cooling fan assembly located in a portion of the electric component room in front of the electric components.

3. The microwave range according to claim 1, wherein cooling of the electric components is performed by a cooling fan assembly located in a portion of the electric component room behind the electric components.

4. The microwave range according to claim 1, further comprising a cover bracket positioned above the electric component room and defining an upper wall thereof.

5. A microwave range having a hood for removing contaminated air, the microwave range comprising:

an electric component room located on an upper wall of a chamber and containing a variety of electric components;

a vent fan assembly that intakes and exhausts contaminated air;

a cooling fan assembly that provides a flow of air for cooling the electric components;

a passage through which air flows by driving of the cooling fan assembly and the vent fan assembly;

a divider that separates the electric component room from the passage, the divider comprising:

a top bracket extending from the upper wall of the chamber to a side of an outer case to form a bottom of the electric component room, the outer case covering an upper portion and both sides of the chamber;

an air wall located on the top bracket and forming a side surface of the electric component room; and a cover bracket located on an upper end of the air wall and forming a ceiling of the electric component room, wherein the vent fan assembly intakes contaminated air flowing through a couple of passages provided between both sides of the chamber and both sides of an outer case positioned over the upper wall and both sides of the chamber.

6. The microwave range according to claim 5, wherein the cooling fan assembly is installed in a fan bracket provided on at least one of the air wall and an air guide.

7. The microwave range according to claim 6, wherein the fan bracket is located in a portion of the electric component room in front of the electric components.

8. The microwave range according to claim 6, wherein the fan bracket is located in a portion of the electric component room behind the electric components.

* * * * *